US009953789B2

(12) United States Patent
Anglade et al.

(10) Patent No.: US 9,953,789 B2
(45) Date of Patent: Apr. 24, 2018

(54) SINGLE-POLE BREAKING UNIT COMPRISING A ROTARY CONTACT BRIDGE, AND A SWITCHGEAR DEVICE, AND CIRCUIT BREAKER COMPRISING SUCH A UNIT

(71) Applicant: Schneider Electric Industries SAS, Rueil-Malmaison (FR)

(72) Inventors: Hervé Anglade, Saint Ismier (FR); Christophe Grumel, Lans en Vercors (FR); Marc Rival, Saint Ismier (FR); Jean-Paul Gonnet, Fontaine (FR)

(73) Assignee: Schneider Electric Industries SAS, Malmaison (FR)

( * ) Notice: Subject to any disclaimer, the term of this patent is extended or adjusted under 35 U.S.C. 154(b) by 4 days.

(21) Appl. No.: 14/974,302

(22) Filed: Dec. 18, 2015

(65) Prior Publication Data

US 2016/0104591 A1 Apr. 14, 2016

Related U.S. Application Data

(63) Continuation-in-part of application No. 13/496,793, filed as application No. PCT/FR2010/000591 on Aug. 30, 2010, now abandoned.

(30) Foreign Application Priority Data

Sep. 18, 2009 (FR) ..... 09 04455
Sep. 18, 2009 (FR) ..... 09 04456

(51) Int. Cl.
*H01H 73/18* (2006.01)
*H01H 9/34* (2006.01)
(Continued)

(52) U.S. Cl.
CPC ..... *H01H 73/18* (2013.01); *H01H 9/342* (2013.01); *H01H 1/2058* (2013.01); *H01H 2009/365* (2013.01)

(58) Field of Classification Search
CPC ..... H01H 9/342; H01H 9/34; H01H 33/73; H01H 71/02; H01H 73/18; H01H 73/02;
(Continued)

(56) References Cited

U.S. PATENT DOCUMENTS 5,298,874 A 3/1994 Morel et al.
5,310,971 A 5/1994 Vial et al.
(Continued)

FOREIGN PATENT DOCUMENTS

DE 198 36 754 A1 2/2000
EP 0 538 149 A1 4/1993
EP 0 560 697 A1 9/1993

OTHER PUBLICATIONS

Translation DE19836754 (original document published Feb. 17, 2000).*

*Primary Examiner* — Renee S Luebke
*Assistant Examiner* — William Bolton
(74) *Attorney, Agent, or Firm* — Steptoe & Johnson LLP

(57) ABSTRACT

A single-pole breaking unit which includes a rotary contact bridge, a stationary contact operating with the contact bridge and connected to a current input, a rotary bar having radially extending axial end surfaces, and radial side surfaces with a transverse hole for the contact bridge which is salient through opposite radial side surfaces of the bar, an arc extinguishing chamber opening onto an opening volume for the contact bridge, two parallel side panels parallel to the axial end surfaces of the bar, with the rotary bar located between two sealing flanges between the axial end surfaces of the rotary bar and the side panels and movable axially toward the side panels to ensure tightness between the inside
(Continued)

and the outside of the breaking unit, the sealing flanges each comprising a radially extending portion, and a cylindrical portion, both co-axial with the rotary bar, which cylindrical portion has an inside radius slightly less than the radial extent of the rotary bar, providing a space between the inside surface of the cylindrical portion and the rotary bar, the space permitting quenching gases to flow directly to push a sealing flange axially against a side panel to achieve tightness.

17 Claims, 8 Drawing Sheets

(51) Int. Cl.
*H01H 1/20* (2006.01)
*H01H 9/36* (2006.01)

(58) Field of Classification Search
CPC ..... H01H 73/04; H01H 71/10; H01H 1/20; H01H 3/02
USPC ..... 218/157, 7, 16, 30–31, 46–48, 110, 113, 218/115, 155–156
See application file for complete search history.

(56) References Cited

U.S. PATENT DOCUMENTS

| | | | | |
|---|---|---|---|---|
| 5,357,066 | A | 10/1994 | Morel et al. | |
| 6,037,555 | A | 3/2000 | Castonguay et al. | |
| 6,310,307 | B1 | 10/2001 | Ciarcia et al. | |
| 6,313,425 | B1 * | 11/2001 | Doughty | H01H 9/345 218/149 |
| 6,750,743 | B1 * | 6/2004 | Subramanian | H01H 1/2058 335/8 |
| 6,791,440 | B2 * | 9/2004 | Harmon | H01H 1/205 335/16 |
| 6,965,292 | B2 * | 11/2005 | Ciarcia | H01H 1/205 337/50 |
| 7,221,246 | B2 * | 5/2007 | Rajauria | H01H 1/205 335/16 |
| 2002/0175147 | A1 * | 11/2002 | Uchida | H01H 1/205 218/30 |
| 2003/0030224 | A1 * | 2/2003 | Nakamura | F16C 29/025 277/431 |
| 2005/0046539 | A1 | 3/2005 | Ciarcia et al. | |
| 2006/0191873 | A1 * | 8/2006 | Asakawa | H01H 9/342 218/22 |
| 2009/0194510 | A1 | 8/2009 | Dahl | |

* cited by examiner

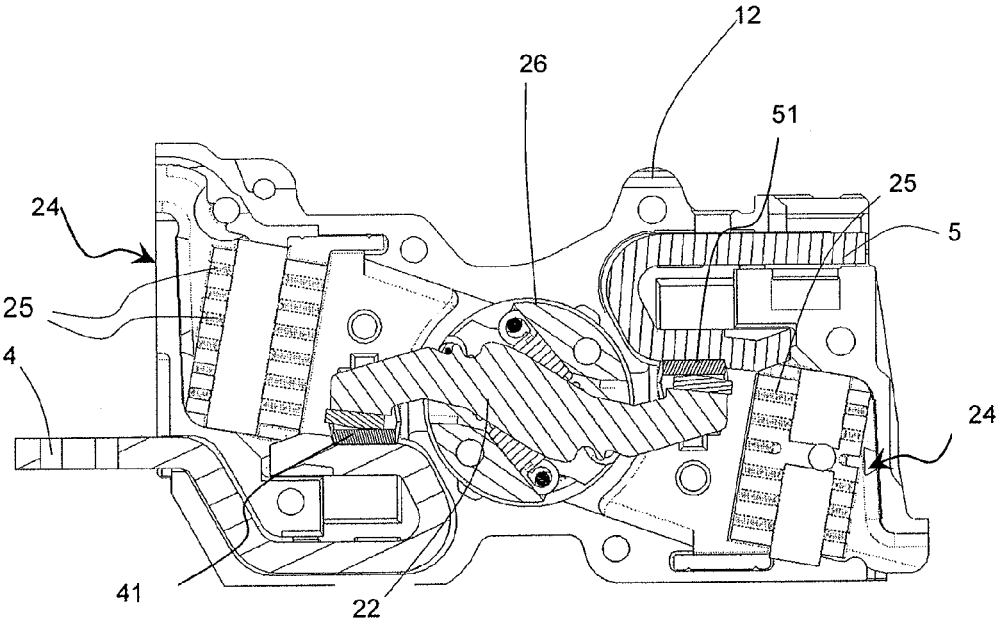
FIGURE 1A (State of Art)
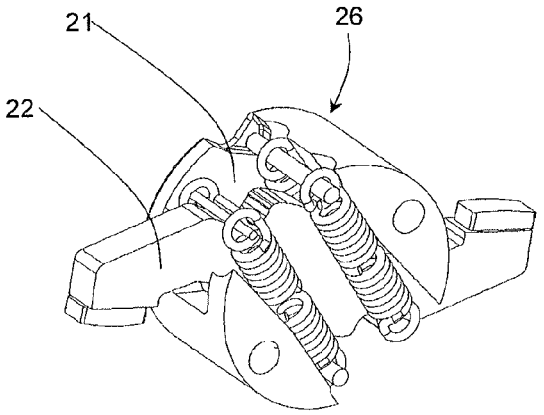
FIGURE 1B (State of Art)

Fig. 8A
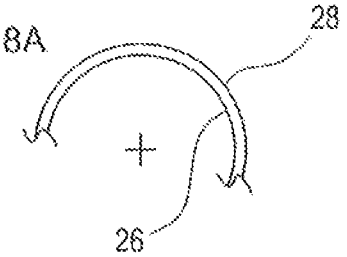
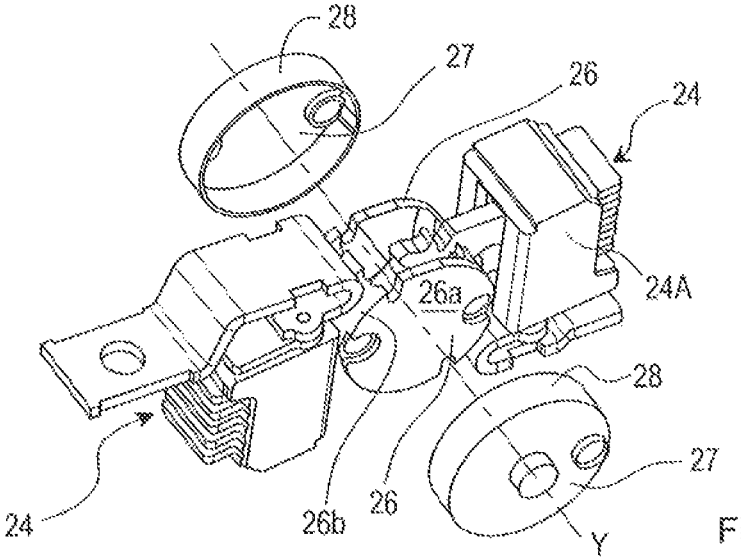
Fig. 8

SINGLE-POLE BREAKING UNIT COMPRISING A ROTARY CONTACT BRIDGE, AND A SWITCHGEAR DEVICE, AND CIRCUIT BREAKER COMPRISING SUCH A UNIT

CROSS-REFERENCE TO RELATED APPLICATIONS

This application is a continuation-in-part of U.S. patent application Ser. No. 13/496,793, filed Mar. 16, 2012, which is a U.S. national stage of PCT International Application No. PCT/FR2010/000591, filed Aug. 30, 2010, which claimed priority of French Patent Applications Nos. 09-04455 and 09-04456, both filed Sep. 18, 2009.

BACKGROUND

The invention relates to a single-pole breaking unit comprising a rotary contact bridge, at least one stationary contact operating in conjunction with said contact bridge and connected to a current input conductor, a rotary bar having a transverse hole accommodating said contact bridge with clearance, which contact bridge is salient on each side of the bar, said rotary bar being inserted between two side panels of the breaking unit, said side panels being substantially parallel to one another. The rotary contact bridge also comprises two sealing flanges respectively placed between the radial surfaces of the rotary bar and the side panels to ensure tightness between the inside and the outside of the breaking unit. At least one arc extinguishing chamber opens onto an opening volume of the contact bridge.

The invention also relates to a switchgear device comprising such a breaking unit.

The invention also relates to a circuit breaker comprising such a switchgear device.

STATE OF THE ART

The use of a contact bridge in switchgear devices is described in numerous patents, including EP0538149 and EP0560697 filed by the present applicant.

As represented in FIGS. 1A and 1B, a moulded case switchgear device comprises a case 12 of insulating plastic material containing breaking elements of a pole, i.e., a pair of stationary contacts 41, 51, a movable contact bridge 22, and two arc extinguishing chambers 24. The case 12 is of generally rectangular shape, formed by two large side panels. The movable contact bridge 22 is supported by a rotary bar 26 located between the two large side panels. The rotary bar 26 passes through accommodating hole 21 in a direction parallel to the large side panels. The movable contact bridge 22 passes through this hole with clearance and is salient on each radial side of the bar 26. The contact bridge 22 is mounted floating on the bar 26. Two current input conductors 4, 5 are connected to the stationary contacts 41, 51.

Ciarcia et al. U.S. Patent Application Publication US200510046539 A1 discloses a circuit breaker rotor assembly flanked by a pair of isolation caps. The isolation caps are sized for secure placement upon the sides of the rotor assembly. While the inner periphery of the caps may have an inner radius substantially the same, or slightly greater than, an outer radius of the outer periphery of the rotor assembly, the caps lie flush with the rotor assembly such that the isolation caps fit securely over the rotor assembly.

To guarantee efficient electric current breaking, gas leaks from the bar 26 have to be avoided. Such gas leaks have the undesirable effects of creating a backflow and hampering insertion of an arc into the arc extinguishing chambers.

Tight sealing between the rotary bar and the moulded case is therefore necessary. This sealing can be achieved by means of two flanges respectively placed on the surfaces of the bar between said bar and the inner wall of the two large side panels. The efficiency of these solutions however remains imperfect. The prior flanges were fitted around the drive spindle with an axial operating clearance that may have been responsible for undesirable passage of gases involved in current breaking.

SUMMARY OF THE INVENTION

The object of the invention is therefore to remedy the shortcomings of the art to provide a breaking unit with a rotary bar comprising efficient sealing means.

The rotary bar of the breaking unit according to the invention comprises at least a channel around the radial peripheries of the rotary bar, which permits quenching gases to flow directly to at least one sealing flange in order to push same against one of the side panels to achieve tightness. While the flange(s) rotate with the rotary bar, the flange(s) can move slightly axially to be pressed against the side panel(s) by arc quenching gases.

Preferably, the sealing flanges comprise cylindrical cheek portions which at least partially cover the longitudinal radial surfaces of the rotary bar. The cylindrical cheek portions also partially close the transverse hole accommodating the bar.

The cylindrical portions are preferably positioned over the entire periphery of the sealing flange.

According to one embodiment of the invention, the sealing flanges comprise at least one off-center passage hole designed for passage of a joining bar to mechanically secure several bars to one another, the joining bar being commanded by a mechanism common to the set of several single-pole units. The off-center location of such a passage hole means that the hole is not co-axial with the rotary bar and the sealing flanges.

Advantageously, the breaking unit comprises a pair of stationary contacts, each stationary contact operating in conjunction with the rotary contact bridge and a current input conductor. The unit comprises two arc extinguishing chambers respectively opening onto an opening volume of the contact bridge. Each arc extinguishing chamber is connected to at least one quenching gas exhaust channel, said exhaust channels opening onto a line-side panel of the case of the breaking unit, said line-side panel being positioned opposite another load-side panel designed to be placed in contact with trip means.

Advantageously, said quenching gas exhaust channels join one another in a common duct opening onto the line-side panel of the case of the breaking unit.

Preferably, the quenching gas exhaust channels of first and second extinguishing chambers, respectively, are of different lengths, the quenching gases flowing in a first gas exhaust channel being designed to suck the gases flowing in a second channel by Venturi effect.

According to another embodiment of the invention, said at least one gas exhaust channel of an arc extinguishing chamber passes through at least one decompression chamber comprising at least one inner wall covered by at least one metal sheet.

The switchgear device according to the invention comprises at least one such breaking unit. Said device comprises an actuating mechanism of the contacts, and is designed to be connected on the one hand to a trip device 7 at the level of the load-side terminal strip 5, and on the other band to a current line to be protected at the level of the line-side terminal strip 4.

The circuit breaker according to the invention comprises a such switchgear device. Said circuit breaker comprises a trip device connected to the load-side terminal strips of the switchgear device.

BRIEF DESCRIPTION OF THE DRAWINGS

Other advantages and features will become more clearly apparent from the following descriptions of particular embodiments of the invention, given for illustrative, not restrictive exemplary purposes only, as represented in the appended drawings, wherein:

FIG. 1A shows a cross-sectional side view of a known single-pole breaking unit.

FIG. 1B shows a perspective view of a rotary bar of the breaking unit of FIG. 1A.

FIGS. 4 to 8 show perspective views of a single-pole breaking unit and a part of its case according to a preferred embodiment of the invention.

FIG. 8A is a partially schematic, radial cross-sectional view of the spaced relationship of a radial side of a rotary bar 26 to the inside surface of an adjacent cylindrical portion 28 of a flange 27.

DETAILED DESCRIPTION OF AN EMBODIMENT

Figure 2:
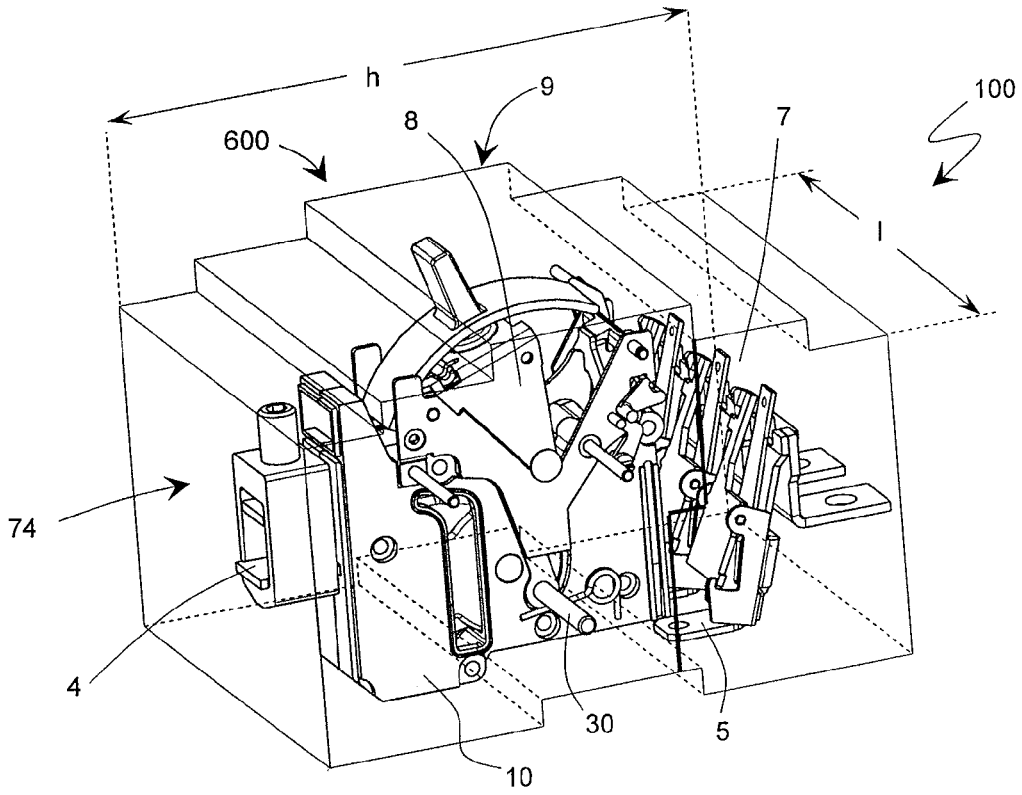
FIG. 2 is a perspective overview of a circuit breaker comprising a switchgear device according to an embodiment of the invention.

According to an embodiment of the invention, the circuit breaker 100 comprises a trip device 7 associated with a switchgear device 600.

The switchgear device 600 according to the invention comprises at least one single-pole breaking unit 10. The single-pole breaking unit according to the invention is designed to be connected on the one hand to the trip device 7 at the level of the line-side terminal strip 5 and on the other hand to a current line to be protected at the level of a line-side terminal strip 4. The single-pole breaking unit 10 is also a cartridge.

Figure 3A:
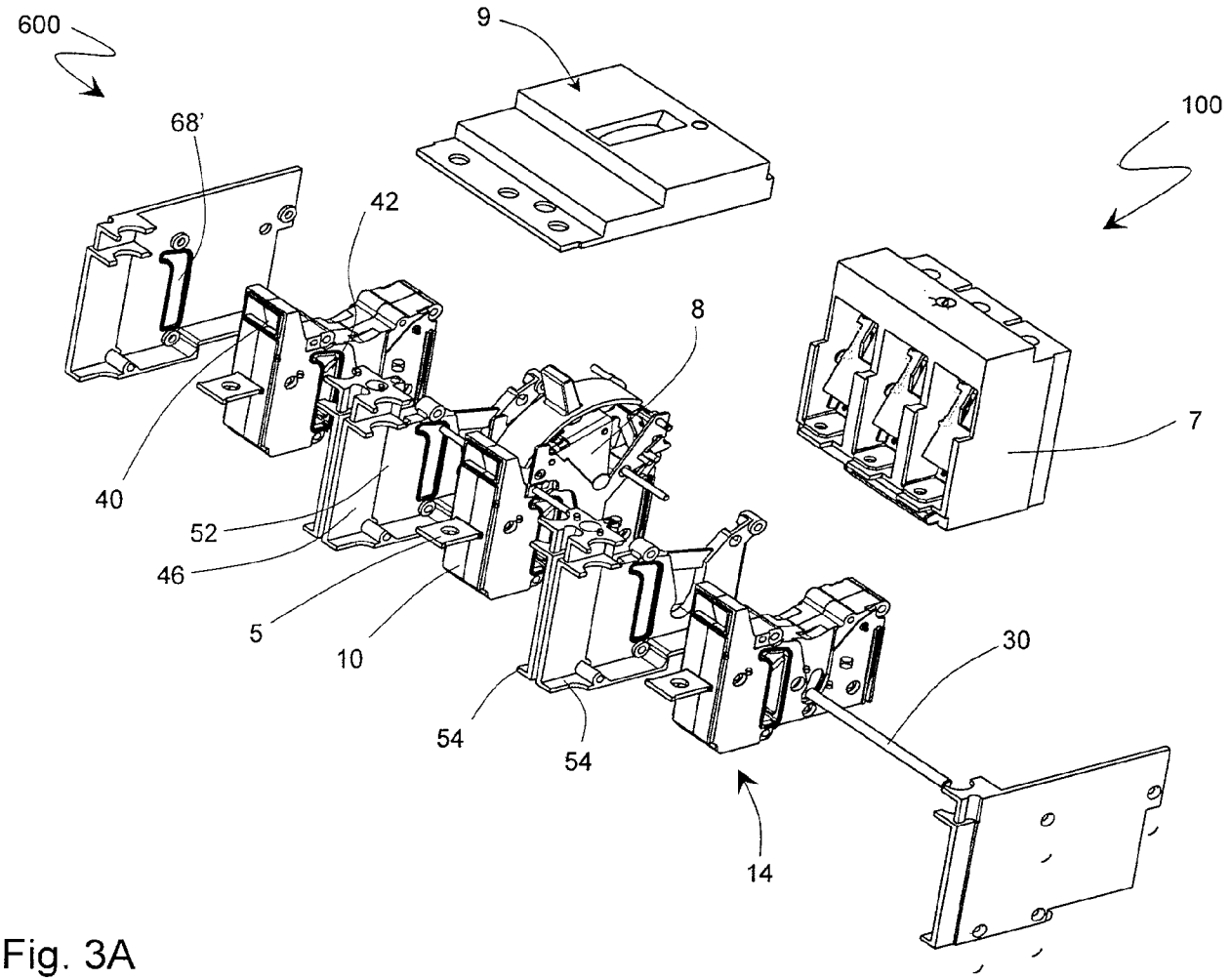
FIG. 3A is an exploded perspective view of a circuit breaker comprising a switchgear device according to an embodiment of the invention.
Figure 3B:
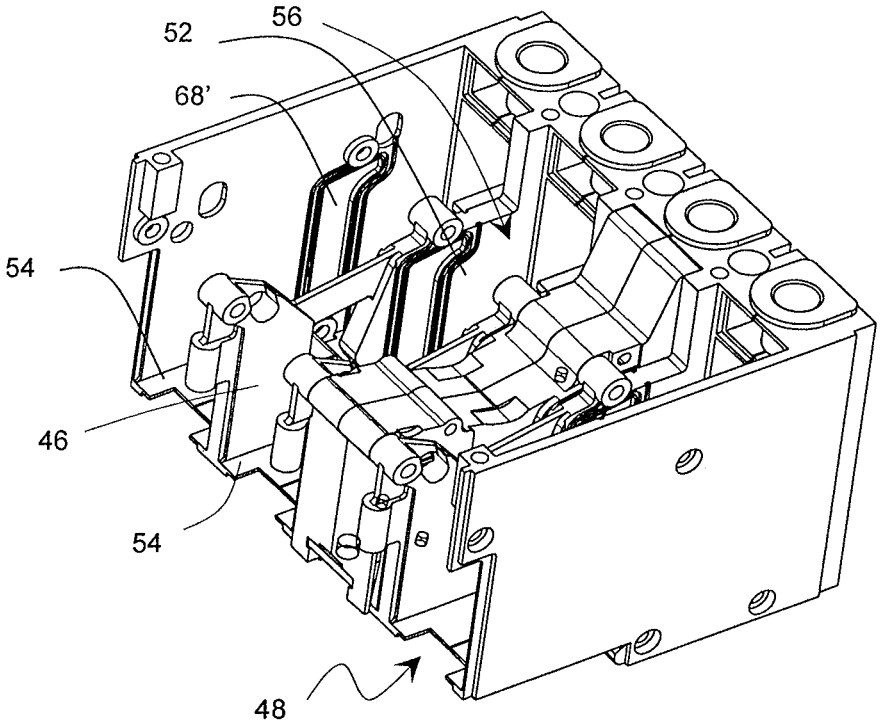
FIG. 3B is a perspective view of switchgear device in the course of assembly according to an embodiment of the invention.
Figure 4:
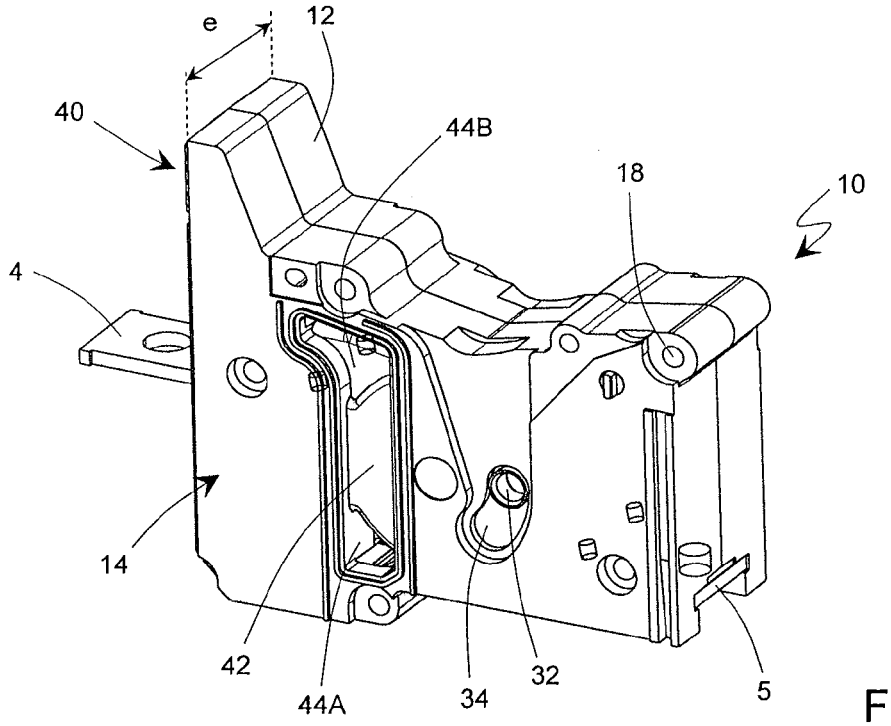

According to a preferred embodiment of the invention as represented in FIGS. 3A, 3B, the switchgear device 600 comprises three single-pole breaking units. The switchgear apparatus 100 is then a three-pole circuit breaker. According to other embodiments which are not represented, the switchgear apparatus could be a single-pole, two-pole or four-pole circuit breaker.

With a concern for simplification of presentation of a preferred embodiment of the invention, the elements comprising the switchgear apparatus 100, and in particular the single-pole breaking units 10 forming the breaking device 600, will be described herein in relation to the position of use in which the circuit breaker 100 is fitted in place in a panel, with the nose 9 comprising a vertical handle parallel to the mounting panel, the line-side connection terminal strips 4 on the electric line located at the top and forming the top surface 74 of the breaking device 100 and the trip device 7 at the bottom. The use of relative position terms such as "lateral", "top", "bottom", etc. should not be interpreted as limiting. The handle is designed to command an actuating mechanism 8 of the electric contacts.

Each single-pole breaking unit 10 enables a single pole to be interrupted. Said unit is advantageously in the form of a flat case 12 made from moulded plastic, with two parallel large panels 14 separated by a thickness e. In particular, in the illustrated embodiment, the thickness e is about 23 mm for a 160 A rating.

The case 12 is formed by two parts, which preferably present mirror symmetry, secured by any suitable means to one another via their large panels 14. As illustrated in a preferred embodiment in FIG. 3, a complementary system of tenon and mortar type enables the parts of case 12 to be adjusted to fit one another, one of the two parts (not shown) comprising suitable prongs to enter recesses of the other part. Arrangements 18 are further provided to enable juxtaposition of the cases 12 of the single-pole unit 10, and securing of the latter for a multipole circuit breaker 100.

The single-pole breaking unit comprises a breaking mechanism 20 housed in the case 12. The breaking mechanism 20 comprises a movable contact bridge 22 able to rotate around an axis of rotation Y. The movable contact bridge 22 comprises at least one end comprising a contact strip. Said contact strip of the movable contact bridge 22 is designed to operate in conjunction with a stationary contact. Said bridge is mounted for pivoting between an open position in which the contact strip is separated from a stationary contact 41, and a closed, current flow position in which it is in contact with the stationary contact 41.

The movable contact bridge 22 is mounted floating in a rotary bar 26 having a transverse hole 21 accommodating said contact bridge. The movable contact bridge 22 passing through the transverse accommodating hole 21 is salient from the bar 26. Said rotary bar 26 is fitted between two side panels 14 of the case 12 of the breaking unit 10.

Figure 5:
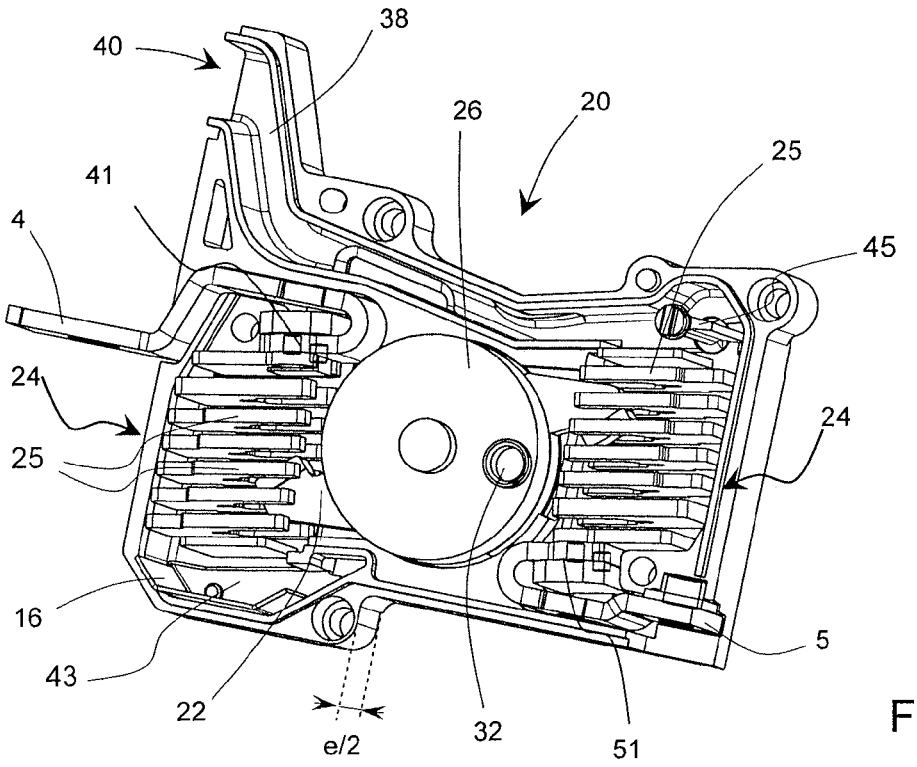
Figure 7:
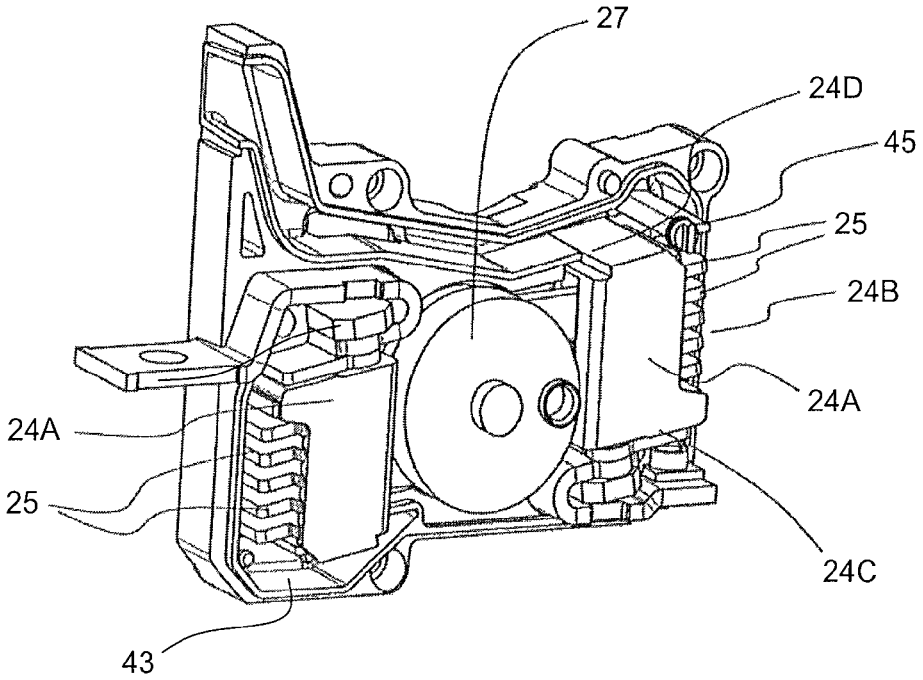

According to an embodiment of the invention represented in FIGS. 5, 7 and 8, two sealing flanges 27, 28 are preferably placed between the radially extending axial end surfaces of the rotary bar 26 and the side panels 14, respectively, to ensure tightness between the inside and the outside of the breaking unit 10.

The rotary bar 26 provides at least one channel in direct connection between the transverse accommodating hole 21 in the rotary bar, and a side panel 14 so that the quenching gases can flow directly via said channel to at least one sealing flange 27, 28 in order to push same against one of the side panels 14 to achieve tight sealing. The sealing flanges 27 also include an off-center passage hole 32 for passage of a joining bar 30 to mechanically secure a plurality of rotary bars 26 to one another, the joining bar 30 being commanded by a mechanism common to, and thereby simultaneously operating, a plurality of single-pole units.

According to a first alternative embodiment the rotary bar 26 comprises multiple channels connected between the transverse accommodating hole 21 in the rotary bar and extending around the periphery of the radially extending axial end surface of the rotary bar 26 so that the quenching gases can flow directly via said channels to the sealing flanges 27 in order to push same against the side panels 14 to achieve tight sealing. The pass-through channels are preferably aligned parallel with the axis of the rotary bar 26 so that the quenching gases can exert a thrust force substantially aligned with the axis of the bar and distributed uniformly on the sealing flanges.

According to a particular embodiment of the sealing flanges 27, said flanges comprise lateral cylindrical cheeks 28 at least partially covering the radial surface of the rotary bar 26 to partially close the transverse accommodating hole 21. The cylindrical lateral cheeks 28 are preferably positioned over the entire periphery of the sealing flange 27.

An exemplary diameter of the bar 26 is 23.8 mm, in a range of about 15 mm to about 50 mm. The inner diameter of the flanges 27 is 24 mm in a range of about 15.2 mm to about 50.2 mm. The space between the radial surfaces of the rotary bar 26 and the internal surface of the cylindrical portion of flange 27 is about 0.2 mm+ or −0.2 mm in width.

The distance between the flange 27 and the internal side of the side panels of the breaking unit is preferably about 0.45 mm, + or −0.2 mm.

According to a preferred embodiment illustrated in FIGS. 5 to 8, the breaking mechanism 20 is of double rotary breaking type. The switchgear apparatus 100 according to the invention is particularly intended for applications up to 630 A, and in certain applications up to 800 A, for which single breaking may not be sufficient. The movable contact bridge 22 then comprises a contact strip at each end. The contact strips of the contact bridge 22 are preferably located symmetrically with respect to the axis of rotation Y. The rotary movable contact bridge 22 passing through the transverse accommodating hole 21 is salient on each side of the rotary bar 26. The breaking unit comprises a pair of stationary contacts 41, 51 designed to operate in conjunction with a contact terminal strip of the movable contact bridge 22. Said bridge is mounted for pivoting between an open position in which the contact strips are separated from the stationary contacts 41, 51, and a current flow position in which they are in contact with the stationary contacts 41, 51. A first stationary contact 41 is designed to be connected to the current line by a line-side terminal strip 4. A second stationary contact 51 is designed to be connected to the trip device 7 by a load-side terminal strip 5. The single-pole breaking unit 10 comprises two arc extinguishing chambers 24 for extinguishing electric arcs. Each arc extinguishing chamber 24 opens onto an opening volume between a contact terminal strip of the contact bridge 22 and a stationary contact 41, 51. Each arc extinguishing chamber 24 is delineated by two side walls 24A, a rear wall 24B away from the opening volume, a bottom wall 24C close to the stationary contact, and a top wall 24D. As represented in FIG. 5, each arc extinguishing chamber 24 comprises a stack of at least two deionizing fins 25 separated from one another by an exchange space of the quenching gases.

As, according to a particular embodiment of the invention as described in particular in French Patent application filed on this day in the name of the Applicant and entitled: "Switchgear device having at least one single-pole breaking unit comprising a contact bridge and circuit breaker comprising such a device", the case 12 of the breaking unit 10 further comprises arrangements for optimization of the gas flow. Each arc extinguishing chamber 24 comprises at least one outlet connected to at least one quenching gas exhaust channel 38, 42. Said exhaust channels 38, 42 are designed to remove the gases via at least one pass-through hole 40 positioned on a line-side panel of the case 12 positioned opposite another load-side panel. The load-side panel of the case 12 is designed to be placed in contact with the trip device 7.

Each arc extinguishing chamber 24 comprises at least one exchange space between two fins 25 connected to a gas exhaust channel 38, 42. All the exchange spaces are preferably connected to the gas exhaust channels 38, 42 at the level of an area at a distance from the volume opening onto the rear wall and at the level of the side walls of the arc extinguishing chamber 24.

According to this embodiment, assembly of the contact bridge 22 and of the rotary bar 26 in a single-pole breaking unit 10 is "reversed". It is desired for the handle 9 of the contact actuating mechanism 8 (see FIGS. 2 and 3A) to be centered on the switchgear device 600 of the circuit breaker 100 in operation, the protective front panel of the electric line protection devices then being able to be symmetrical. For this purpose, inversion of the direction of rotation of the bar 26 has been chosen, i.e., the connection terminal strip 5 to the trip device 7 is located towards the rear of the circuit breaker 100 and the line-side connection terminal strip 4 is located towards the front, at the top.

The movable contact bridge 22 is thus rotary in the clockwise direction between an open position and a closed position of the contacts. Thus, in this preferred embodiment in which the direction of rotation of the rotary contact bridge is reversed, gas exhaust from the contact connected to the load-side terminal strip 5, which should in traditional manner be directed downwards and towards the rear of the apparatus, is displaced to the top and the front of the breaking unit 10. The area located at the rear and at the bottom of the apparatus corresponds to an area in which the trip device 7 and any fixing supports that may exist, such as in particular a DIN rail, are placed. In particular, the substantially rectangular shape of the enclosure of the case 12 of the breaking unit 10 is extended on the front side by a first gas exhaust channel 38. Said first channel enables the quenching gases to be directed from the load-side terminal strip 5 coupled with the trip device 7 to the top part of the switchgear apparatus 100. The quenching gases are removed to the outside of the case via a pass-through hole 40. The positioning of the pass-through hole 40 in the top part of the breaking device and in particular above the line-side terminal strip 4 also reduces the risks of arc flashovers.

The exhaust gases emanating from the contact 41 connected to the line-side terminal strip 4 are further advantageously also directed upwards and towards the front of the breaking unit 10 via at least one second exhaust channel 42. In particular, said at least one exhaust channel 42 is at least partially positioned in the parallel large panels 14 of the case 12 of the breaking unit 10.

Figure 6:
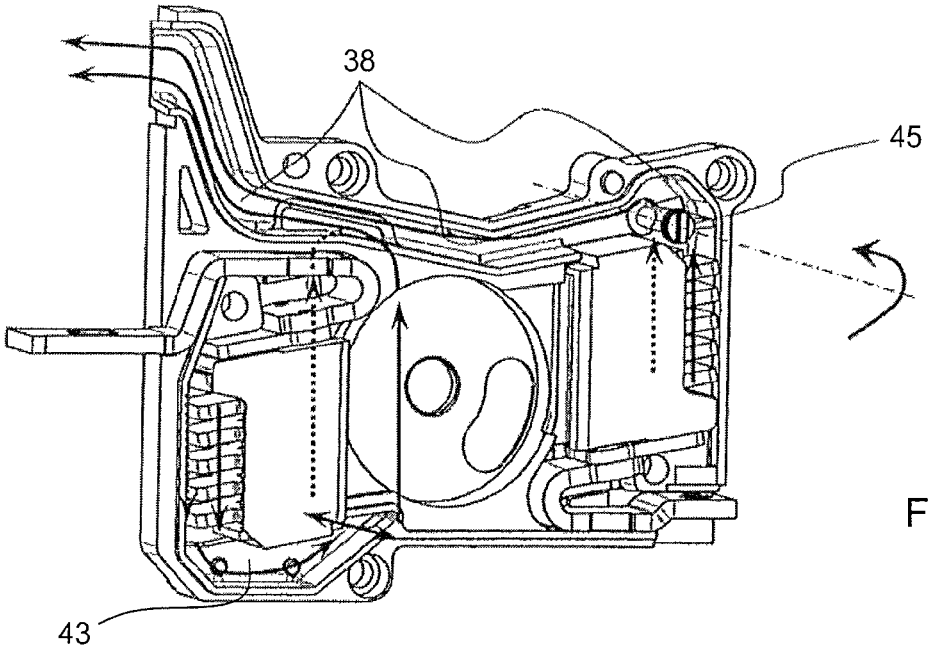

As represented in FIG. 6, according to another embodiment, two lateral exhaust channels 42 are arranged partially outside the case 12 of the breaking unit 10. These two channels are connected to one and the same arc extinguishing chamber 24. Each lateral exhaust channel 42 is connected to the inside of the case 12 by two holes 44A, 44B. The external part of the lateral exhaust channel 42 can preferably be hollowed out in the wall of the case 12.

According to a mode of development of the invention represented in FIGS. 5 and 6, all the gas exhaust channels 38, 42 join one another in a common duct opening onto the line-side panel of the case 12 of the breaking unit 10. The quenching gases are then removed via a single pass-through hole 40. The gases generated at the time breaking takes place in the arc extinguishing chambers 24 are thus advantageously directed away from the trip device 7 and from any fixing supports that may exist, such as for example a DIN rail.

According to a first alternative embodiment, the gas exhaust channels 38 and 42 respectively of a first and second arc extinguishing chamber 24 are of different lengths, the quenching gases flowing in a first gas exhaust channel being designed to suck the gases flowing in a second channel by Venturi effect.

Advantageously, each part of the case 12 is moulded with internal arrangements enabling relatively stable positioning of the different elements composing the breaking mechanism 20, in particular two symmetrical housings for each of the arc extinguishing chambers 24, and a circular central housing enabling the bar 26 to be fitted.

As, according to a particular embodiment of the invention as described in particular in French Patent application filed on this day in the name of the Applicant and entitled: "Functional spacer for separating the cartridges in a multi-pole breaking device and circuit breaker", the single-pole units 10 are assembled by means of spacers 46 to form a double enclosure 48. It is advantageous to take advantage of this architecture to integrate each lateral exhaust channel 42 partly in the spacer 46. In particular, as illustrated in FIGS. 3A, 3B, the spacers 46 are made from moulded plastic and mainly comprise a central partition 52 designed to be parallel to the large panels 14 of the breaking units 10. Juxtaposition of two spacers 46 thus defines a cavity 56 in which a single-pole breaking unit 10 is housed. Advantageously, two opposite bottom edges 54 of each spacer 46 close the cavity 56 at the rear thereof in substantially tightly sealed manner when clamping of the spacers 46 on one another is performed. Each spacer 46 comprises arrangements enabling the second lateral gas exhaust channels 42 to be partially defined. Advantageously, each lateral exhaust channel 42 is partially etched in the external large panel 14 of the case 12 of the cartridge 10, between the two outlet holes 44A, 44B and a corresponding element 68, etching and/or salient contour, on the central partition 52. When juxtaposition and clamping of the spacer 46 on the cartridge 10 are performed, the gases can then be directed from the outlet hole 44A to the top hole 44B along the partition 52.

The single-pole breaking units 10 are designed to be driven simultaneously and are coupled for this purpose by least one rod 30, extending through rotary bar 26 and holes 32 in flanges 27. According to a preferred embodiment, a single drive rod 30 is used and each part of case 12 comprises a hole 34 in the form of an arc of a circle enabling at least some lateral movement of the rod 30 and thereby forming limiting stops of the movable contact bridge 22 between the current flow position and the open position.

According to a particular embodiment of the invention as represented in FIGS. 5 to 7, said at least second gas exhaust channel 42 passes through at least one decompression chamber 43 comprising at least one wall covered by a metal sheet 85.

The inner wall covered by said sheet preferably forms part of a decompression chamber 43. This metal sheet 85 constitutes a particle trap which serves the purpose on the one hand of capturing the metallic particles originating from breaking in order on the one hand to thermally protect the plastic parts situated downstream from the trap and on the other hand to reduce the temperature of the quenching gases. The particle trap further protects the plastic parts of the channel situated behind said at least one metal sheet 85 and enhances the tightness of the sealing surface of the case 12.

The use of at least one metal sheet 85 at least partially covering the inner wall of the gas exhaust channel enables good capture of the molten steel and copper balls resulting from erosion of the separators, contacts and conductors when current breaking takes place. Said at least one metal sheet comprises a minimum thickness to prevent the molten balls from transpiercing the latter. The minimum thickness is preferably comprised between 0.3 and 3 mm to be adjusted according to the breaking energy of the product.

Said at least one metal sheet 85 is made from steel, copper or an iron-based alloy.

Figures 9A, 9B:
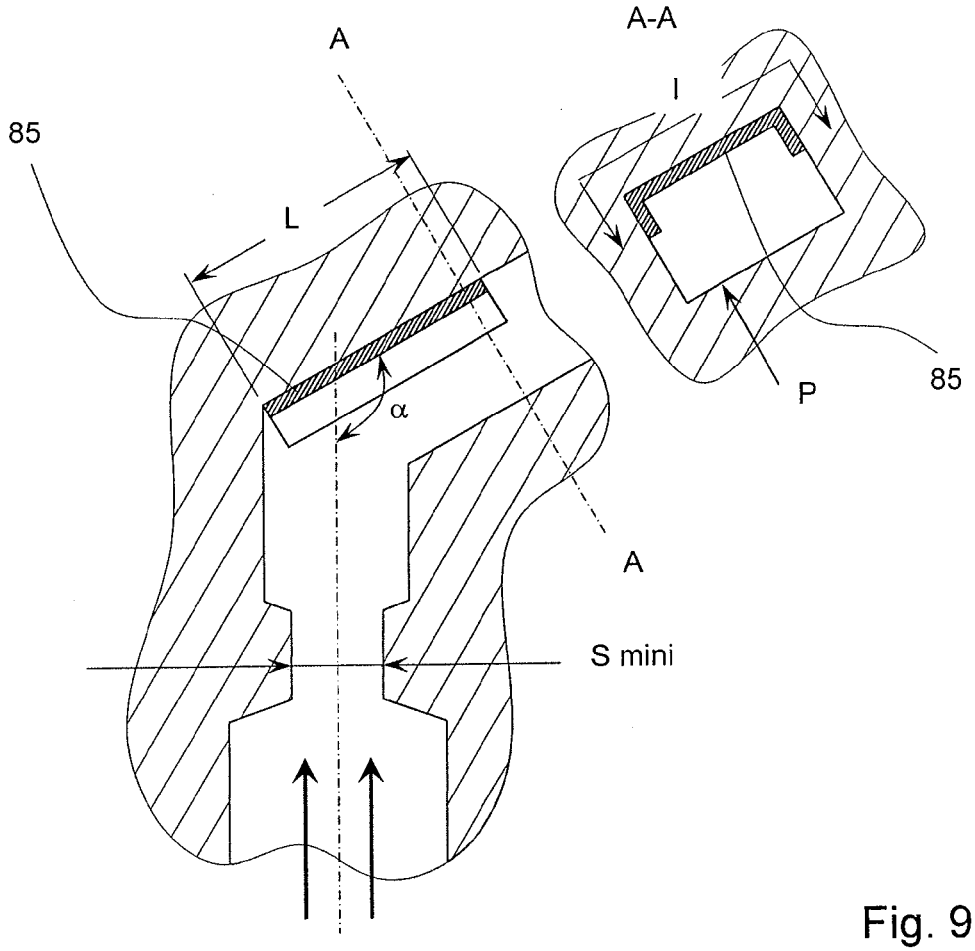
FIGS. 9A and 9B show cross-sectional views of a gas exhaust channel of a breaking unit according to the invention.

As represented in FIG. 9A, the inner wall of the exhaust channel covered by said at least one metal sheet 85 of the particle trap forms an angle $\alpha$ comprised between 45° and 140° with respect to the direction of flow of the gases. The wall supporting said at least one metal sheet is preferably in a perpendicular plane to the direction of flow of the quenching gases ($\alpha$=90°). In practice, by placing said at least one metal sheet 85 in a curve or in the exit of a curve of the gas flow, pressing and adhesion of the particles against the sheet are promoted due to centrifugal force.

Said at least one metal sheet 85 at least partially covers the inner surface of the exhaust channel. The metal sheet extends along the longitudinal axis of the channel. The total length L of inner wall covered by said at least one metal sheet 85 in the direction of flow is at least equal to the square root of the smallest cross-section of flow S of the channel measured upstream from said sheet. The largest possible length is desirable to reduce the temperature of the gases. The required minimum length is expressed according to the following equation:

$$L \geq \sqrt{S\min}$$

wherein Smin is the surface of the minimum cross-section of the exhaust channel.

Said at least one metal sheet 85 further extends on the internal perimeter P of the exhaust channel in a perpendicular direction to the gas flow direction. The required minimum distance I over which said sheet extends is expressed according to the following equation:

$$Pm/10 \leq 1 \leq Pm$$

wherein Pm is the mean perimeter of the gas exhaust channel in which the particle trap is situated.

Said decompression chamber is preferably positioned as close as possible to the outlet of the arc extinguishing chamber. According to a particular embodiment, the decompression chamber is placed under the bottom wall of the arc extinguishing chamber 24.

According to a second variant of the embodiments, a gas exhaust channel 38 comprises a rotary valve 45 designed to be driven in rotation by flow of the quenching gases. Rotation of the valve from a first position to a second position is designed to actuate trip means of the switchgear apparatus to bring about opening of the contacts.

The circuit breaker 100 according to the invention obtained in this way enables the following at first sight antinomic industrial requirements to be complied with to the extent possible:

- the same architecture can be used for the whole range up to 800 A due to the use of double breaking with movable contact bridge 22;
- the dependability of the breaking mechanisms 20 and optimization of the latter are ensured by the use of well-proven solutions;
- the trip device 7 can be connected via the bottom to the load-side terminal strip of the switchgear device 600, thereby giving better accessibility to the connecting screws due to reversal of the direction of rotation of the rotary contact breaking bridge 22;

interchangeability of the trip devices 7 is complete, enabling greatly delayed differentiation of the switchgear apparatuses 100;

the nose 9 of the switchgear device 600 is centered, in particular at 42.5 mm, due to reversal of the direction of rotation in the breaking units 10, enabling symmetrical front cover plates to be used in the cabinets;

the quenching gases are not removed next to the trip device 7, thereby limiting pollution on this element which may be sensitive, in particular in its electronic version, and freeing space;

outlet of the quenching gases is no longer performed under the connections 4, 5 of the circuit breaker 100, thereby limiting the risks of arc flashovers on breaking.

What is claimed is:

1. A single-pole breaking unit comprising:

a rotary contact bridge, at least one stationary contact operating in conjunction with said contact bridge and connected to a current input conductor, a rotary bar having an axis of rotation, radially extending end surfaces, and side surfaces extending longitudinally parallel to said axis, and having a transverse hole accommodating said contact bridge with clearance, which contact bridge is salient diametrically through opposite side surfaces of the bar, at least one are extinguishing chamber opening onto an opening volume for the contact bridge, two side panels substantially parallel to one another and to the radially extending axial end surfaces of the bar, with the rotary bar located between said side panels, two sealing flanges, with the radially extending axial end surfaces of the rotary bar located between said two sealing flanges which are movable axially toward the side panels to provide a gas-tight seal between the flanges and side panels of the breaking unit, said sealing flanges each comprising a radially extending portion and a cylindrical portion which are co-axial with the rotary bar, and which cylindrical portion has an inside radius which is slightly more than the radial extent of the side surfaces of the rotary bar, thereby providing an interior space between the cylindrical portion of the flange and the side surfaces of the rotary bar, said space permitting quenching gases to flow directly to at least one sealing flange for pushing same axially against one of the side panels to achieve said tightness.

2. The breaking unit according to claim 1, wherein the rotary bar comprises channels connecting with the transverse accommodating hole and passing radially outside said radial side surface so that quenching gases can flow directly via said channels to the sealing flanges for pushing same against the side panels to achieve tightness.

3. The breaking unit according to claim 2, wherein the channels are aligned with a longitudinal axis of the rotary bar so that the quenching gases can exert a thrust force substantially aligned with a longitudinal axis of the rotary bar and distributed uniformly on the sealing flanges.

4. The breaking unit according to claim 1, wherein the cylindrical portions of sealing flanges at least partially cover the side surfaces of the rotary bar.

5. The breaking unit according to claim 4, wherein the cylindrical portions partially close the transverse hole accommodating the contact bridge.

6. The breaking unit according to claim 5, wherein the cylindrical portions extend around the entire periphery of the sealing flanges.

7. The breaking unit according to claim 1, wherein the sealing flanges comprise at least one off-center passage hole for passage of a joining bar to mechanically secure a plurality of rotary bars to one another, the joining bar being commanded by a mechanism common to a plurality of single-pole units.

8. The breaking unit according claim 1, which comprises:

a pair of stationary contacts, each stationary contact operating in conjunction with the rotary contact bridge and a current input conductor;

two arc extinguishing chambers respectively opening onto an opening volume of the contact bridge, each extinguishing chamber being connected to at least one quenching gas exhaust channel, said exhaust channels opening onto a line-side panel of the case of the breaking unit, said line-side panel being positioned opposite another panel designed to be placed in contact with trip means.

9. The breaking unit according to claim 8, wherein said quenching gas exhaust channels join one another in a common duct opening onto the line-side of the breaking unit.

10. The breaking unit according to claim 9, wherein the quenching gas exhaust channels respectively of a first and second extinguishing chamber are of different lengths, for causing the quenching gases to flow in a first gas exhaust channel designed to suck the gases flowing in a second channel by Venturi effect.

11. The breaking unit according to claim 10, wherein said at least one gas exhaust channel of an arc extinguishing chamber passes through at least one decompression chamber comprising at least one inner wall covered by a metal sheet.

12. A switchgear device comprising at least one breaking unit according to claim 1, and comprising a contact actuating mechanism, said at least one breaking unit designed to be connected to a trip device a load-side terminal strip, and to a current line to be protected at a line-side terminal strip.

13. A circuit breaker comprising a switchgear device according to claim 12, which also comprises a trip device connected to the load-side terminal strips of the switchgear device.

14. The breaking unit according to claim 1, wherein the inside surface of the cylindrical portion of the flange is spaced about 0.2 mm+ or −0.2 mm from the radial side surface of the rotary bar.

15. The breaking unit according to claim 14, wherein the diameter of the rotary bar is in the range of about 15 mm to about 55 mm.

16. The breaking unit according to claim 14, wherein the inner diameter of the cylindrical portion of the flange is in the range of about 15.2 mm to about 50.2 mm.

17. The breaking unit according to claim 1, wherein, before the sealing flanges are pushed toward the side panels, the sealing flanges are spaced about 0.45 mm+ or −0.2 mm from the inside surface of panels.

* * * * *